US012171303B2

(12) United States Patent
Rathburn et al.

(10) Patent No.: US 12,171,303 B2
(45) Date of Patent: Dec. 24, 2024

(54) UPPER FOR ARTICLE OF FOOTWEAR WITH FOREFOOT AIRFLOW FEATURES

(71) Applicant: LULULEMON ATHLETICA CANADA INC., Vancouver (CA)

(72) Inventors: Samuel Scott Rathburn, Portland, OR (US); Kathryn Carey Fleming, Portland, OR (US)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 161 days.

(21) Appl. No.: 17/932,048

(22) Filed: Sep. 14, 2022

(65) Prior Publication Data

US 2024/0081470 A1 Mar. 14, 2024

(51) Int. Cl.

| | |
|---|---|
| ***A43B 7/06*** | (2006.01) |
| ***A43B 7/08*** | (2022.01) |
| ***A43B 23/02*** | (2006.01) |

(52) U.S. Cl.

CPC ..... *A43B 7/06* (2013.01); *A43B 7/085* (2013.01); *A43B 23/0245* (2013.01)

(58) Field of Classification Search

CPC ..... A43B 7/06; A43B 7/08; A43B 23/0245; A43B 3/20; A43B 3/126

See application file for complete search history.

(56) References Cited

U.S. PATENT DOCUMENTS

| | | | | |
|---|---|---|---|---|
| 391,005 | A | 10/1888 | Munsing | |
| 757,424 | A * | 4/1904 | Vohl | A43B 7/06 36/3 A |
| 1,965,969 | A | 7/1934 | Sturtevant | |
| 2,047,724 | A | 7/1936 | Zuckerman | |
| 2,675,631 | A | 4/1954 | Doughty | |

(Continued)

FOREIGN PATENT DOCUMENTS

| | | | |
|---|---|---|---|
| CN | 202478337 | U | 10/2012 |
| CN | 203841215 | U | 9/2014 |

(Continued)

OTHER PUBLICATIONS

International Search report and Written Opinion mailed Feb. 5, 2024 for U.S. Patent Application No. PCT/IB2023/000528.

(Continued)

*Primary Examiner* — Katharine G Kane

(74) *Attorney, Agent, or Firm* — Plumsea Law Group, LLC

(57) ABSTRACT

An upper for an article of footwear includes a three-dimensional engineered textile having an inner section, an outer section, and an intermediate section disposed between the inner section and the outer section. The intermediate section is attached to the inner section on one side and the outer section on an opposite side. The intermediate section extends through at least a forefoot region of the upper. In the forefoot region, the intermediate section includes a plurality of curving portions arranged adjacent to each other such that each curving portion of the plurality of curving portions is spaced apart from neighboring curving portions by one or more gaps. Air is configured to flow from an interior of the upper to an exterior of the upper through the one or more gaps between neighboring curving portions of the plurality of curving portions in the forefoot region of the upper.

20 Claims, 11 Drawing Sheets

(56) References Cited

U.S. PATENT DOCUMENTS

| | | | | |
|---|---|---|---|---|
| 3,641,603 | A | 2/1972 | Lockwood | |
| 4,531,525 | A | 7/1985 | Richards | |
| 4,702,091 | A | 10/1987 | Good et al. | |
| D318,944 | S | 8/1991 | Lucas | |
| 5,345,638 | A | 9/1994 | Nishida | |
| 6,401,364 | B1 | 6/2002 | Burt | |
| 6,558,784 | B1 | 5/2003 | Norton et al. | |
| 6,691,535 | B2 | 2/2004 | Gotta et al. | |
| 7,210,248 | B2 | 5/2007 | Van Noy et al. | |
| D639,042 | S | 6/2011 | Gibson | |
| D651,391 | S | 1/2012 | Mokos | |
| 8,321,984 | B2 | 12/2012 | Dojan et al. | |
| 8,429,835 | B2 | 4/2013 | Dojan et al. | |
| 8,572,866 | B2 | 11/2013 | Dojan et al. | |
| 8,578,535 | B2 | 11/2013 | Dojan et al. | |
| D702,930 | S | 4/2014 | Rademacher | |
| 9,192,204 | B1 * | 11/2015 | Liles | A43C 1/00 |
| 9,320,312 | B2 | 4/2016 | Lyttle et al. | |
| 9,351,532 | B2 | 5/2016 | Mokos | |
| 9,572,404 | B2 | 2/2017 | Dojan et al. | |
| 9,775,409 | B2 * | 10/2017 | Meythaler | A43B 23/0205 |
| 9,826,799 | B2 | 11/2017 | Dojan et al. | |
| 9,949,524 | B2 | 4/2018 | Lyttle et al. | |
| 10,051,917 | B2 | 8/2018 | Dojan et al. | |
| 10,111,495 | B2 * | 10/2018 | Polegato Moretti | A43B 7/125 |
| 10,238,177 | B2 | 3/2019 | Mokos | |
| 10,595,591 | B2 | 3/2020 | Dojan et al. | |
| 10,645,998 | B2 * | 5/2020 | Shaffer | A43B 1/0027 |
| D886,430 | S | 6/2020 | Birkinhead | |
| 10,694,804 | B2 | 6/2020 | Lyttle et al. | |
| 10,980,316 | B2 | 4/2021 | Nonogawa et al. | |
| 11,186,930 | B2 | 11/2021 | Huffa et al. | |
| 11,297,901 | B2 | 4/2022 | Shaffer et al. | |
| 11,311,080 | B2 | 4/2022 | Dojan et al. | |
| 2003/0145632 | A1 | 8/2003 | Roe | |
| 2004/0003629 | A1 | 1/2004 | Mitchell | |
| 2005/0016023 | A1 * | 1/2005 | Burris | B29D 35/146 36/55 |
| 2005/0193592 | A1 | 9/2005 | Dua et al. | |
| 2005/0208850 | A1 * | 9/2005 | Baron | D04B 1/16 442/329 |
| 2005/0241179 | A1 * | 11/2005 | Chen | A43B 7/085 36/3 R |
| 2007/0180730 | A1 * | 8/2007 | Greene | A43C 1/006 36/3 R |
| 2008/0200087 | A1 * | 8/2008 | Chen | B32B 5/26 442/305 |
| 2009/0220760 | A1 * | 9/2009 | Chen | B32B 5/26 428/217 |
| 2010/0154256 | A1 | 6/2010 | Dua | |
| 2012/0318026 | A1 | 12/2012 | Dua et al. | |
| 2013/0019500 | A1 * | 1/2013 | Greene | A43B 13/122 36/50.1 |
| 2013/0025157 | A1 | 1/2013 | Wan et al. | |
| 2013/0219749 | A1 | 8/2013 | Dojan et al. | |
| 2013/0232815 | A1 * | 9/2013 | Meythaler | A43B 5/025 428/140 |
| 2013/0239438 | A1 | 9/2013 | Dua et al. | |
| 2013/0312284 | A1 | 11/2013 | Berend et al. | |
| 2014/0115923 | A1 * | 5/2014 | Meythaler | B29D 35/126 156/278 |
| 2014/0130374 | A1 | 5/2014 | Minami et al. | |
| 2014/0196315 | A1 * | 7/2014 | Beye | D04B 21/20 428/119 |
| 2014/0352178 | A1 | 12/2014 | Bruce et al. | |
| 2014/0360048 | A1 * | 12/2014 | DeHaven | A43B 23/0295 36/83 |
| 2015/0052778 | A1 * | 2/2015 | Kirk | A43B 1/04 442/204 |
| 2015/0366281 | A1 * | 12/2015 | Miller | B32B 5/022 428/137 |
| 2016/0007686 | A1 * | 1/2016 | Dojan | A43B 23/0265 36/83 |
| 2017/0071290 | A1 * | 3/2017 | Follet | A43C 15/16 |
| 2017/0348935 | A1 * | 12/2017 | Leimer | A43B 23/0245 |
| 2018/0035757 | A1 * | 2/2018 | Meythaler | B32B 27/12 |
| 2018/0206585 | A1 | 7/2018 | Cai | |
| 2020/0390194 | A1 * | 12/2020 | Chen | D04B 1/24 |
| 2021/0177097 | A1 * | 6/2021 | Thompsett | A43B 23/0235 |

FOREIGN PATENT DOCUMENTS

| | | | |
|---|---|---|---|
| CN | 203986393 | U | 12/2014 |
| CN | 204181061 | U | 3/2015 |
| CN | 104382283 | B | 3/2018 |
| EP | 2630885 | A1 | 8/2013 |
| JP | 2002/065303 | A | 3/2002 |
| JP | 2002/129401 | A | 5/2002 |
| WO | 92/22223 | | 12/1992 |
| WO | 1998/043506 | | 10/1998 |

OTHER PUBLICATIONS

Stoll Sirix 100 / 200 Manual Part 1 and Part 2.

Hong, et al., "The development of 3D shaped knitted fabrics for technical purposes on a flat knitting machine," IJFTR 19(3), Sep. 1994 NISCAIR-CSIR, India.

Susan E. Lewis and Julia Weissman A Machine Knitter's Guide to Creating Fabrics ( Dec. 1986) Larks Books.

* cited by examiner

UPPER FOR ARTICLE OF FOOTWEAR WITH FOREFOOT AIRFLOW FEATURES

BACKGROUND

The present embodiments relate generally to an upper for an article of footwear, and, in particular, to an upper for an article of footwear with airflow features for ventilation.

Conventional articles of footwear may be used for a variety of different activities. Often, these activities can cause a foot of a wearer to increase in temperature and may generate perspiration. Depending on the materials used to construct the upper of the article of footwear, the heat and/or perspiration may become trapped inside the interior of the upper of the article of footwear.

There is a need in the art for an article of footwear having an upper that provides improved ventilation to a wearer.

SUMMARY

In one aspect, the disclosure provides an upper for an article of footwear. The upper includes a three-dimensional engineered textile having an inner section, an outer section, and an intermediate section disposed between the inner section and the outer section. The intermediate section is attached to the inner section on one side and the outer section on an opposite side. The intermediate section extends through at least a forefoot region of the upper. In the forefoot region, the intermediate section includes a plurality of curving portions arranged adjacent to each other such that each curving portion of the plurality of curving portions is spaced apart from neighboring curving portions by one or more gaps. Air is configured to flow between an interior of the upper and an exterior of the upper through the one or more gaps between neighboring curving portions of the plurality of curving portions in the forefoot region of the upper.

In another aspect, the disclosure provides an upper for an article of footwear. The upper includes a three-dimensional engineered textile having an inner section, an outer section, and an intermediate section disposed between the inner section and the outer section. The intermediate section is attached to the inner section on one side and the outer section on an opposite side and extends through at least a forefoot region of the upper. In the forefoot region, the intermediate section includes at least a first curving portion and a second curving portion arranged adjacent to each other so that the first curving portion is spaced apart from the second curving portion by a gap. Air is configured to flow between an interior of the upper and an exterior of the upper through the gap between the first curving portion and the second curving portion in the forefoot region of the upper.

In another aspect, the disclosure provides an upper for an article of footwear. The upper includes a three-dimensional engineered textile having an inner section, an outer section, and an intermediate section disposed between the inner section and the outer section. The intermediate section is attached to the inner section on one side and the outer section on an opposite side and extends through at least a forefoot region of the upper. In the forefoot region, the intermediate section includes a plurality of curving portions arranged adjacent to each other such that each curving portion of the plurality of curving portions is spaced apart from neighboring curving portions by one or more gaps. In a midfoot region of the upper, the inner section is a foam layer.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
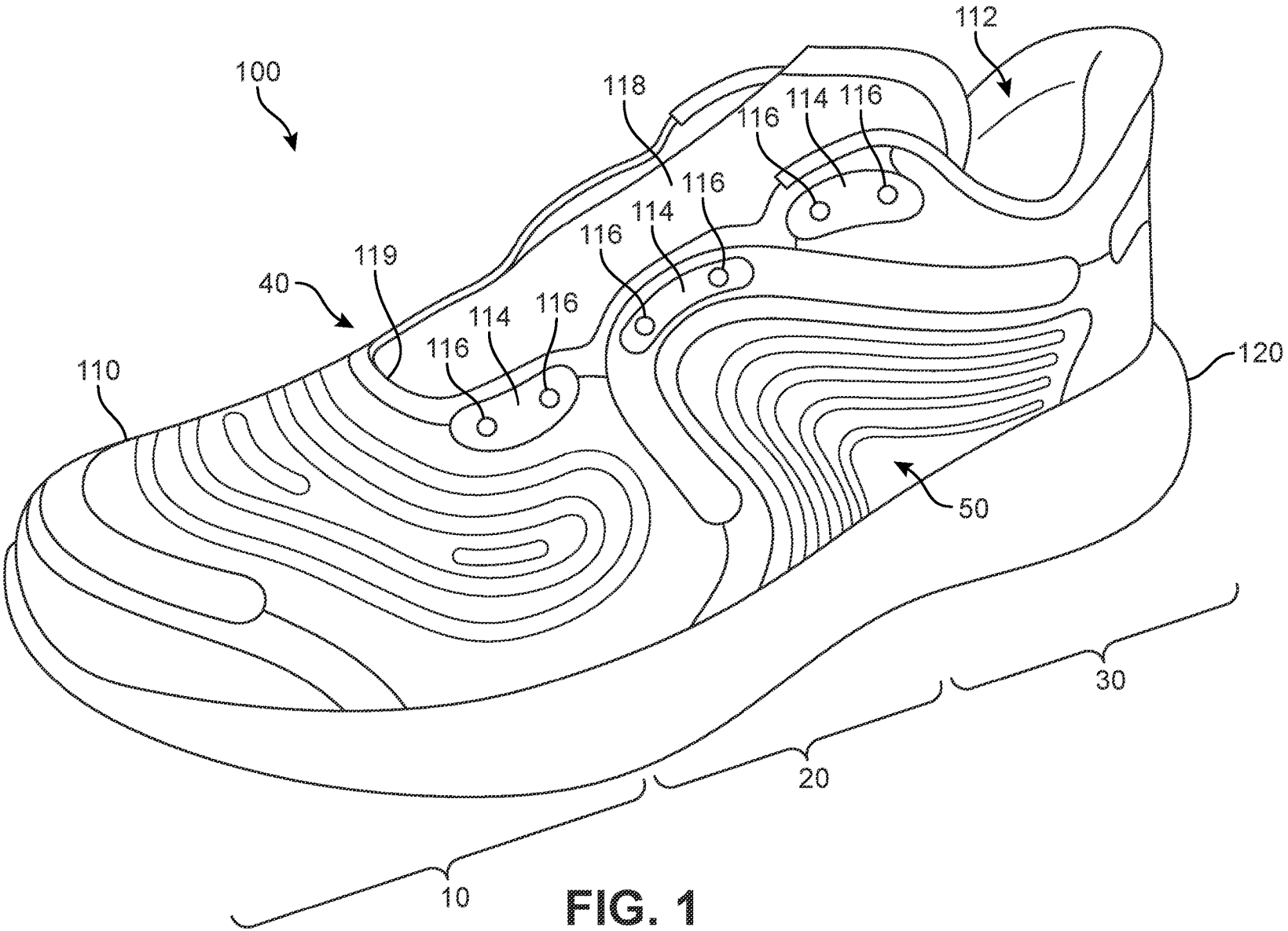
FIG. 1 is an isometric view of an example embodiment of an article of footwear including an upper with airflow features.

Articles of footwear having an upper with airflow features in a forefoot region are described herein. The techniques of the present embodiments provide an upper for an article of footwear that allows air to flow between an interior of the upper and an exterior in a forefoot region of the upper. With this arrangement, ventilation may be provided to a foot of a wearer of the article of footwear.

For consistency and convenience, directional adjectives are employed throughout this detailed description corresponding to the illustrated embodiments. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface. The terms "medial," "lateral," "anterior," "posterior," and the like are intended to refer to anatomical directions corresponding to a human on whom an article is configured to be placed or worn. For example, "medial" refers to a relative position disposed toward the center of the human body, while "lateral" refers to a relative position disposed away from the center of the human body. With respect to footwear, the term "anterior" refers to a relative position closer to the toe of a wearer and "posterior" refers to a relative position closer to the heel of the wearer. In the absence of a wearer, the same directional terms may be used as if the article of footwear is being worn in its expected configuration.

The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article.

Terms such as "up," "down," "vertical," "horizontal," and the like should be understood in the context of the particular article in question. For example, an article may be oriented around defined X, Y, and Z axes, with the X axis corresponding to the longitudinal direction and the Y axis corresponding to the lateral direction. In those examples, the X-Y plane will define horizontal, with up being defined as the positive Z direction and down being defined as the negative Z direction. Furthermore, the term "vertical" as used throughout this detailed description and in the claims refers to a direction generally perpendicular to the X-Y plane and/or the lateral and longitudinal directions. For example, in cases where an article is planted flat on a ground surface, the vertical direction may extend from the ground surface upward. It will be understood that each of these directional adjectives may be applied to individual components of an article, such as an upper and/or a sole assembly.

FIGS. 1 through 11 illustrate an example embodiment of an article of footwear 100. For clarity, the following detailed description discusses on example embodiment, in the form of a running shoe, but it should be noted that the techniques described herein could be applied to any form of an article of footwear including, but not limited to: sneakers, training shoes, yoga shoes, soccer shoes, football shoes, basketball shoes, baseball shoes, rugby shoes, other types of sports shoes, casual shoes, hiking boots, as well as other kinds of footwear. As shown in FIGS. 1 through 11, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 11, for purposes of reference, article 100 may include forefoot region 10, midfoot region 20 and heel region 30. Forefoot region 10 may be generally associated with the toes and joints connecting the metatarsals with the phalanges. Midfoot region 20 may be generally associated with the arch of a foot. Likewise, heel region 30 may be generally associated with the heel of a foot, including the calcaneus bone. In addition, article 100 may include medial side 40 and lateral side 50. In particular, medial side 40 and lateral side 50 may be opposing sides of article 100. Furthermore, both medial side 40 and lateral side 50 may extend through forefoot region 10, midfoot region 20 and heel region 30.

It will be understood that forefoot region 10, midfoot region 20 and heel region 30 are only intended for purposes of description and are not intended to demarcate precise regions of article 100, but rather, to describe relative positions. Likewise, medial side 40 and lateral side 50 are intended to represent generally two sides of an article, rather than precisely demarcating article 100 into two halves. In addition, forefoot region 10, midfoot region 20 and heel region 30, as well as medial side 40 and lateral side 50, can also be applied to individual components of an article, such as a sole assembly and/or an upper.

Article 100 may include an upper 110 and a sole assembly 120. In some embodiments, sole assembly 120 may be configured to provide traction for article 100. In addition to providing traction, sole assembly 120 may attenuate ground reaction forces when compressed between the foot and the ground during walking, running or other ambulatory activities. The configuration of sole assembly 120 may vary significantly in different embodiments to include a variety of conventional or non-conventional structures. In some cases, the configuration of sole assembly 120 can be configured according to one or more types of ground surfaces on which sole assembly 120 may be used. Examples of ground surfaces include, but are not limited to: dirt, concrete, pavement, natural turf, synthetic turf, as well as other surfaces.

Sole assembly 120 is secured to upper 110 and extends between the foot and the ground when article 100 is worn. In different embodiments, sole assembly 120 may include different components. For example, sole assembly 120 may include an outsole, a midsole, and/or an insole. In some cases, one or more of these components may be optional. Moreover, in some cases, sole assembly 120 may itself be optional.

Upper 110 may be generally configured to receive and cover a foot. To this end, upper 110 may include an opening 112 that provides entry to an interior of upper 110 and/or article 100. In addition, upper 110 may include provisions for tightening or otherwise fastening upper 110 and article 100 to a foot of a wearer. In some embodiments, for example, upper 110 may be provided with one or more lace receiving members 114, which may include a plurality of eyelets 116 that are configured to receive a lace. Although not shown in the present embodiments, some embodiments of article 100 may include a lace or other fastening member that may be used to adjust the size of opening 112 and therefore the fit of upper 110 around a foot of a wearer.

Some embodiments of upper 110 may include a tongue 118. Tongue 118 may facilitate comfort and fit of upper 110 and/or article 100. In an example embodiment, tongue 118 extends longitudinally from opening 112 through a throat area of upper 110 to a front end 119 of the throat area in a direction towards forefoot region 10. Tongue 118 is configured to cover an instep of a foot of a wearer of article 100. In other embodiments, however, a tongue may be optional.

Figure 2:
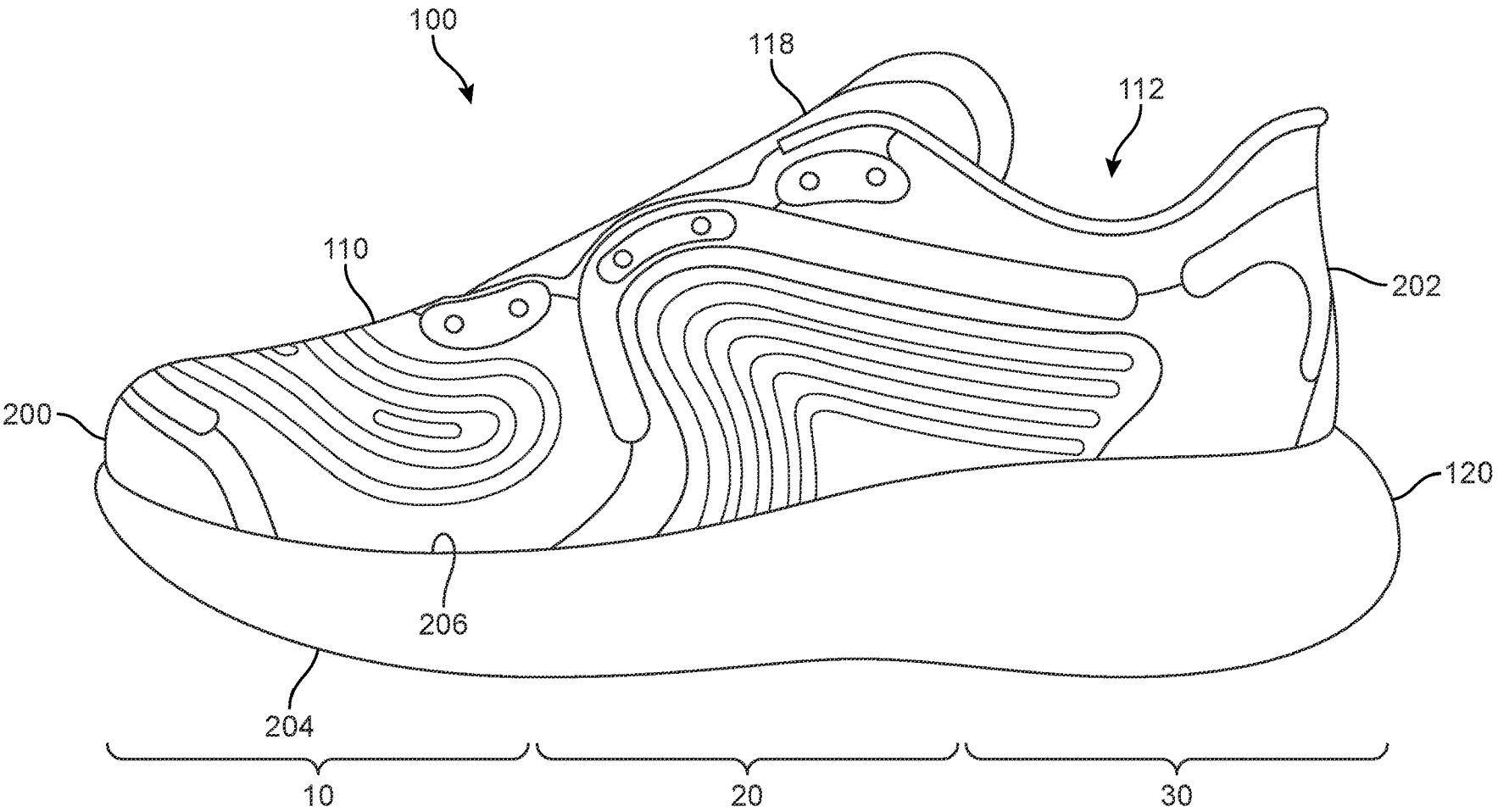
FIG. 2 is a lateral side view of the example embodiment of an article of footwear including an upper with airflow features.

FIG. 2 illustrates lateral side 50 of article 100. In an example embodiment, upper 110 of article 100 extends from a toe end 200 located at a front portion of article 100 to a heel end 202 located at a rear portion of article 100 longitudinally opposite toe end 200. In one embodiment, sole assembly 120 extends from toe end 200 to heel end 202 through each of forefoot region 10, midfoot region 20, and heel region 30 of article 100. As shown in FIG. 2, sole assembly 120 includes a lower surface 204 that extends along a bottom of sole assembly 120. In an example embodiment, lower surface 204 of sole assembly 120 is configured to contact a ground surface when article 100 is worn. In one embodiment, sole assembly 120 may extend in a vertical direction from lower surface 204 to an upper edge 206 that is adjacent to upper 110 of article 100. In some cases, upper edge 206 may define a bite line or boundary where upper 110 and sole assembly 120 meet on each side of article 100 (e.g., on medial side 40 and lateral side 50).

Figure 3:
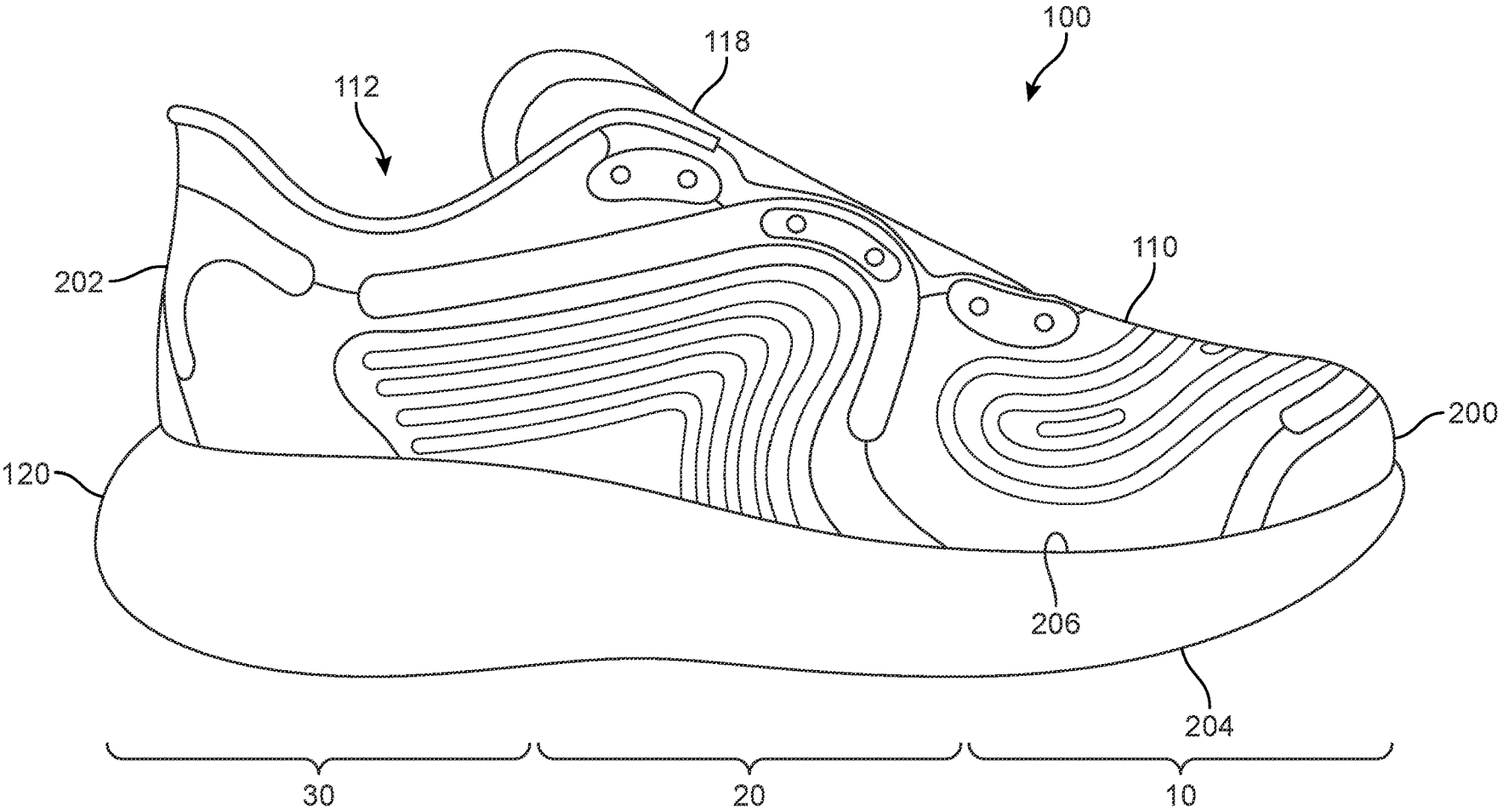
FIG. 3 is a medial side view of the example embodiment of an article of footwear including an upper with airflow features.

FIG. 3 illustrates medial side 40 of article 100. In an example embodiment, upper 110 may have a similar arrangement on each of medial side 40 and lateral side 50. In other embodiments, upper 110 of article 100 may have an asymmetrical arrangement so that portions of upper 110 on medial side 40 are different from portions of upper 110 on lateral side 50. In addition, in this embodiment, sole assembly 120 has a substantially similar arrangement on each of medial side 40 and lateral side 50. For example, as shown in FIG. 3, sole assembly 120 extends in a vertical direction from lower surface 204 to upper edge 206 that is adjacent to upper 110 of article 100 on medial side 40 in a similar manner as on lateral side 50. However, in other embodiments, sole assembly 120 may extend to different heights in the vertical direction on medial side 40 and lateral side 50 of upper 110.

Figure 4:
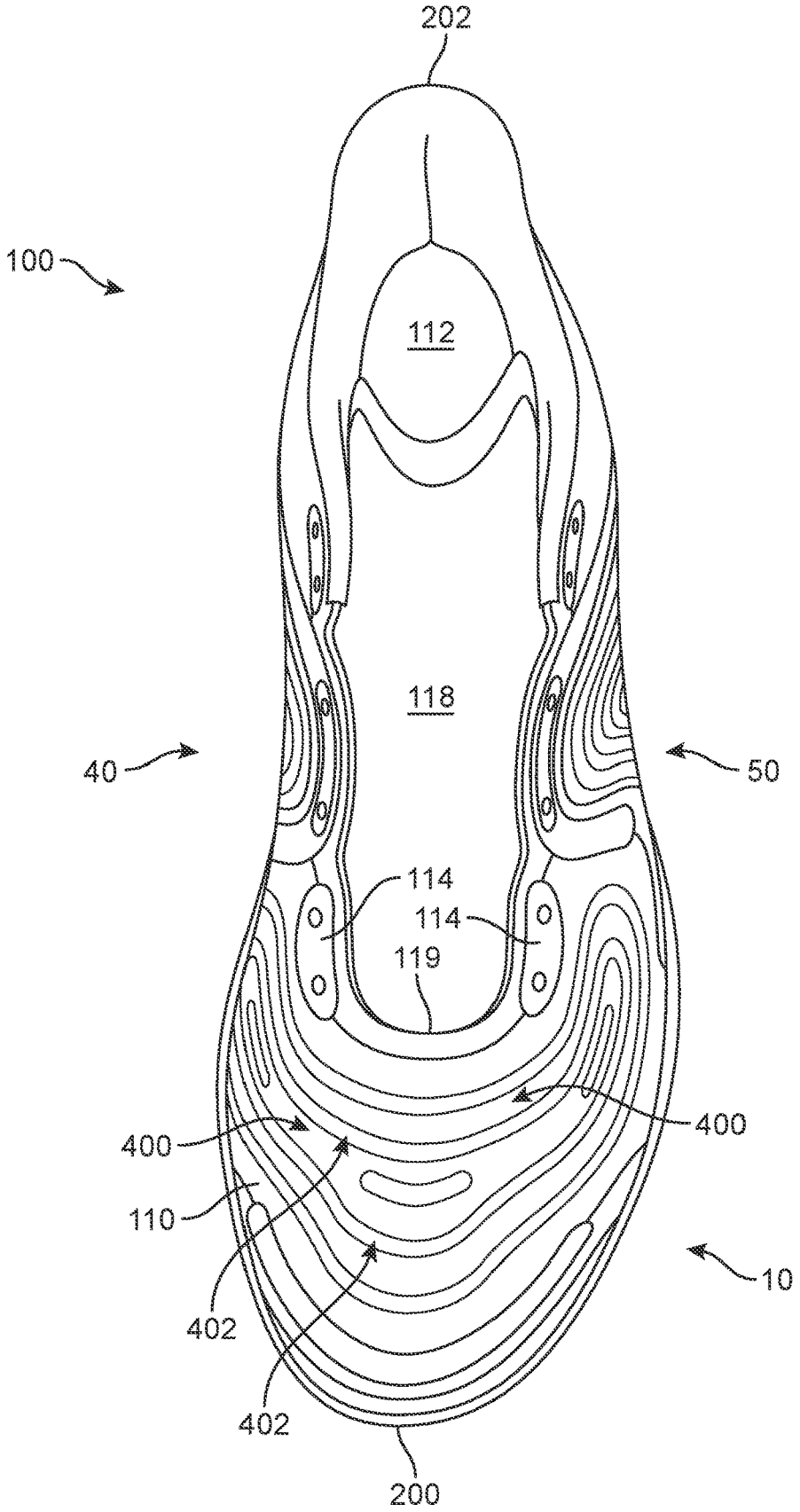
FIG. 4 is a top down view of the example embodiment of an article of footwear including an upper with airflow features.

Referring now to FIG. 4, a top down view of article 100 and upper 110 is shown. In some embodiments, portions of upper 110 may be formed at least partially from a three-dimensional engineered textile. The three-dimensional engineered textile may be manufactured as a single textile component with multiple sections integrally connected to each other as part of the manufacturing process, for example, through weaving, knitting, or other forms of textile production. In an example embodiment, the sections of the three-dimensional engineered textile are arranged substantially in a three-dimensional relationship, such that each section is disposed above or below adjacent sections along a Z-axis that extends through a thickness of the three-dimensional engineered textile that is perpendicular to an X-Y plane defined by a length and width of the three-dimensional engineered textile.

In an example embodiment, the three-dimensional engineered textile forming portions of upper 110 may include an inner section, an outer section, and an intermediate section disposed between the inner section and the outer section along a Z-axis that extends through a thickness of the three-dimensional engineered textile. The intermediate section is attached to the inner section on one side and the outer section on an opposite side during manufacturing of the three-dimensional engineered textile, for example, through weaving, knitting, or other forms of textile production. In this embodiment, the intermediate section extends through at least forefoot region 10 of upper 110. In other embodiments, the intermediate section may extend through additional portions of upper 110, including portions of midfoot region 20 and/or heel region 30 of upper 110.

In some embodiments, upper 110 of article 100 may be provided with airflow features in at least forefoot region 10 that are configured to allow air to flow between an interior of upper 110 and an exterior of upper 100 in at least forefoot region 10. With this arrangement, increased ventilation may be provided to a foot of a wearer of article of footwear 100. In an example embodiment, the intermediate section of the three-dimensional engineered textile forming upper 110 may be produced with airflow features in the form of spaced apart curving portions that are separated by gaps that allow air to move between the interior and the exterior of upper 110 in at least forefoot region 10 of article of footwear 100.

In one embodiment, upper 110 may include a plurality of curving portions 400. As shown in FIG. 4, plurality of curving portions 400 are located at least in forefoot region 10 of upper 110. According to the principles of the embodiments described herein, plurality of curving portions 400 are made as part of the intermediate section of the three-dimensional engineered textile forming at least a portion of upper 110 of article 100. In an example embodiment, plurality of curving portions 400 are arranged adjacent to each other such that each curving portion of plurality of curving portions 400 is spaced apart from neighboring curving portions by one or more gaps 402. Gaps 402 are portions of the three-dimensional engineered textile forming upper 110 where the intermediate section is not present. That is, at the location of gaps 402, the three-dimensional engineered textile forming upper 110 includes a portion of the inner section and a portion of the outer section that are directly facing each other without the intermediate section located in between. With this arrangement, plurality of curving portions 400 separated by gaps 402 in forefoot region 10 of upper 110 allow air to move or flow between the interior of upper 110 of article 100 and the exterior through one or more gaps 402 between neighboring curving portions of plurality of curving portions 400 to provide ventilation for a foot of a wearer.

Figure 5:
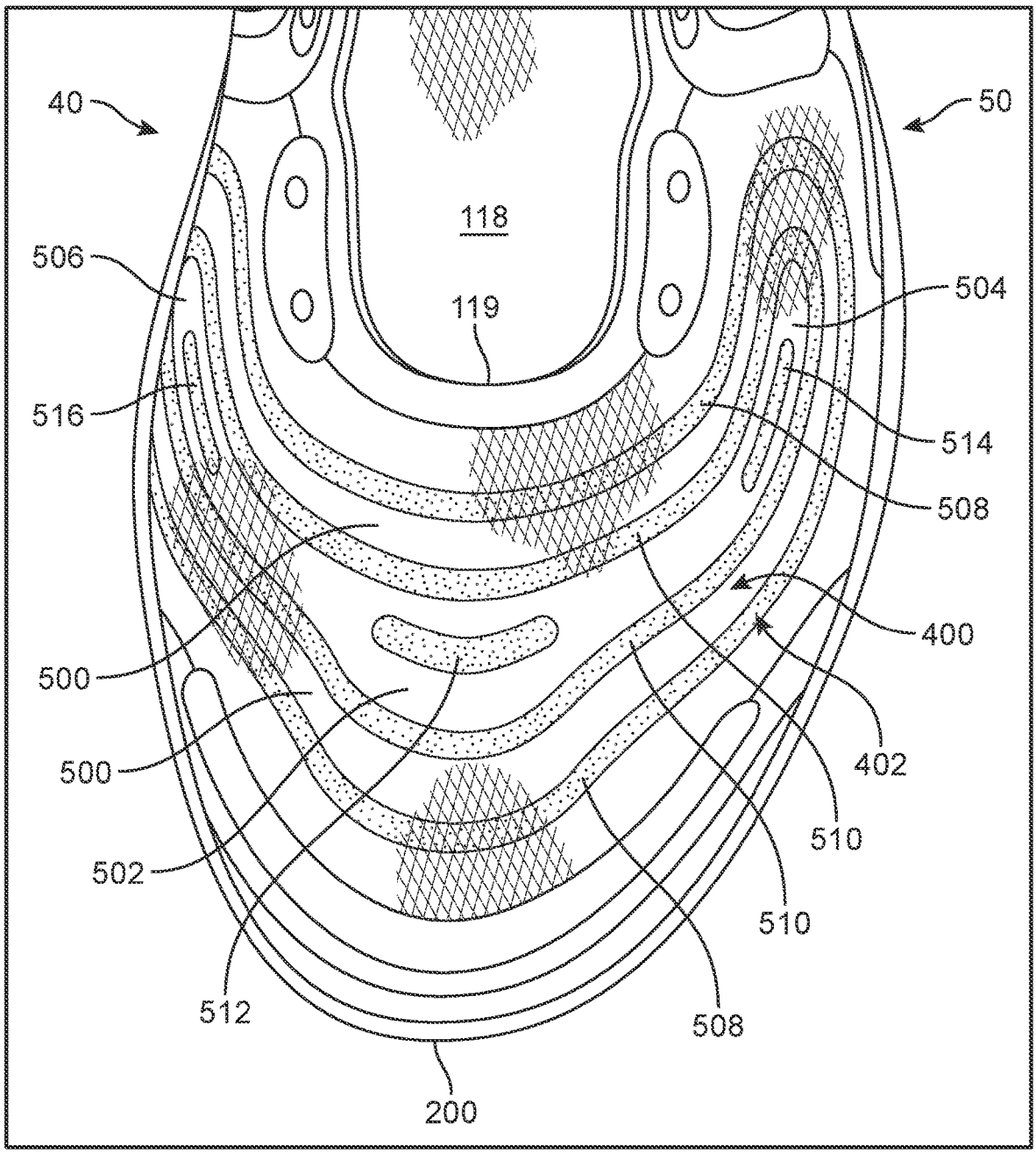
FIG. 5 is an enlarged view of an example embodiment of a forefoot region of an article of footwear including an upper with airflow features.

Referring now to FIG. 5, an enlarged view of forefoot region 10 of upper 110 including plurality of curving portions 400 is shown. In this embodiment, plurality of curving portions 400 includes a first curving portion 500. As shown in FIG. 5, first curving portion 500 extends from an outer periphery of medial side 40 of forefoot region 10 through an outer periphery of a toe portion adjacent to toe end 200 to an outer periphery of lateral side 50 of forefoot region 10 across a top portion of forefoot region 10 adjacent to front end 119 of the throat area and connects back with itself at the outer periphery of medial side 40. In this embodiment, first curving portion 500 is surrounded by a first gap 508 that follows the curve of first curving portion 500 around forefoot region 10 and separates first curving portion 500 from the remaining portion of upper 110 in forefoot region 10.

Plurality of curving portions 400 also includes a second curving portion 502 that is spaced apart from first curving portion 500 by a second gap 510 that surrounds second curving portion 502 and separates first curving portion 500 and second curving portion 502. In this embodiment, second curving portion 502 is smaller than first curving portion 500 such that first curving portion 500 bounds second curving portion 502. That is, second curving portion 502 is contained within an area enclosed or bordered by first curving portion 500.

In some embodiments, one or more curving portions of plurality of curving portions 400 may be in the form of a loop. In some cases, the loop may be a closed loop that extends in an unbroken, continuous manner that connects back to itself. In other cases, the loop may be a loop with one or more discontinuous portions where the loop is interrupted at one or more breaks but which continues on a path that connects back to itself. In these embodiments, plurality of curving portions 400 may form a plurality of loops arranged in a nested configuration such that each loop of the plurality of loops is spaced apart from each adjacent loop by a gap of the one or more gaps 402. For example, in one embodiment, first curving portion 500 may form a first loop and second curving portion 502 may form a second loop that is smaller than the first loop such that the second loop is bounded inside the first loop (e.g., nested within the first loop).

In one embodiment, second curving portion 502 may include a triangular shaped looped portion that is disposed approximately in a middle of forefoot region 10 on a top portion of upper 110. The triangular shaped looped portion of second curving portion 502 includes a central opening 512. Central opening 512 is formed in a similar manner as gaps 402, by forming a portion of the three-dimensional engineered textile where the intermediate section is not present at the location corresponding to central opening 512. With this arrangement, central opening 512 allows air to move or flow between the interior of upper 110 of article 100 and the exterior to provide ventilation for a foot of a wearer.

In some embodiments, second curving portion 502 may also include a lateral loop 504 on lateral side 50 of forefoot region 10 and a medial loop 506 on medial side 40 of forefoot region 10. Each of lateral loop 504 and medial loop 506 includes an opening in the center of the loop. For example, as shown in FIG. 5, lateral loop 504 includes a first opening 514 and medial loop 506 includes a second opening 516. Each of first opening 514 and second opening 516 are formed in a similar manner as gaps 402 and/or central opening 512, for example, by omitting the intermediate section of the three-dimensional engineered textile forming upper 110 at locations corresponding to first opening 514 and second opening 516.

In one embodiment, medial loop 506 extends from a first end of the triangular shaped looped portion of second curving portion 502 on one side and lateral loop 504 extends from a second end of the triangular shaped looped portion of second curving portion 502 on an opposite side. Together, the triangular shaped looped portion, lateral loop 504, and medial loop 506 define second curving portion 502.

Figure 6:
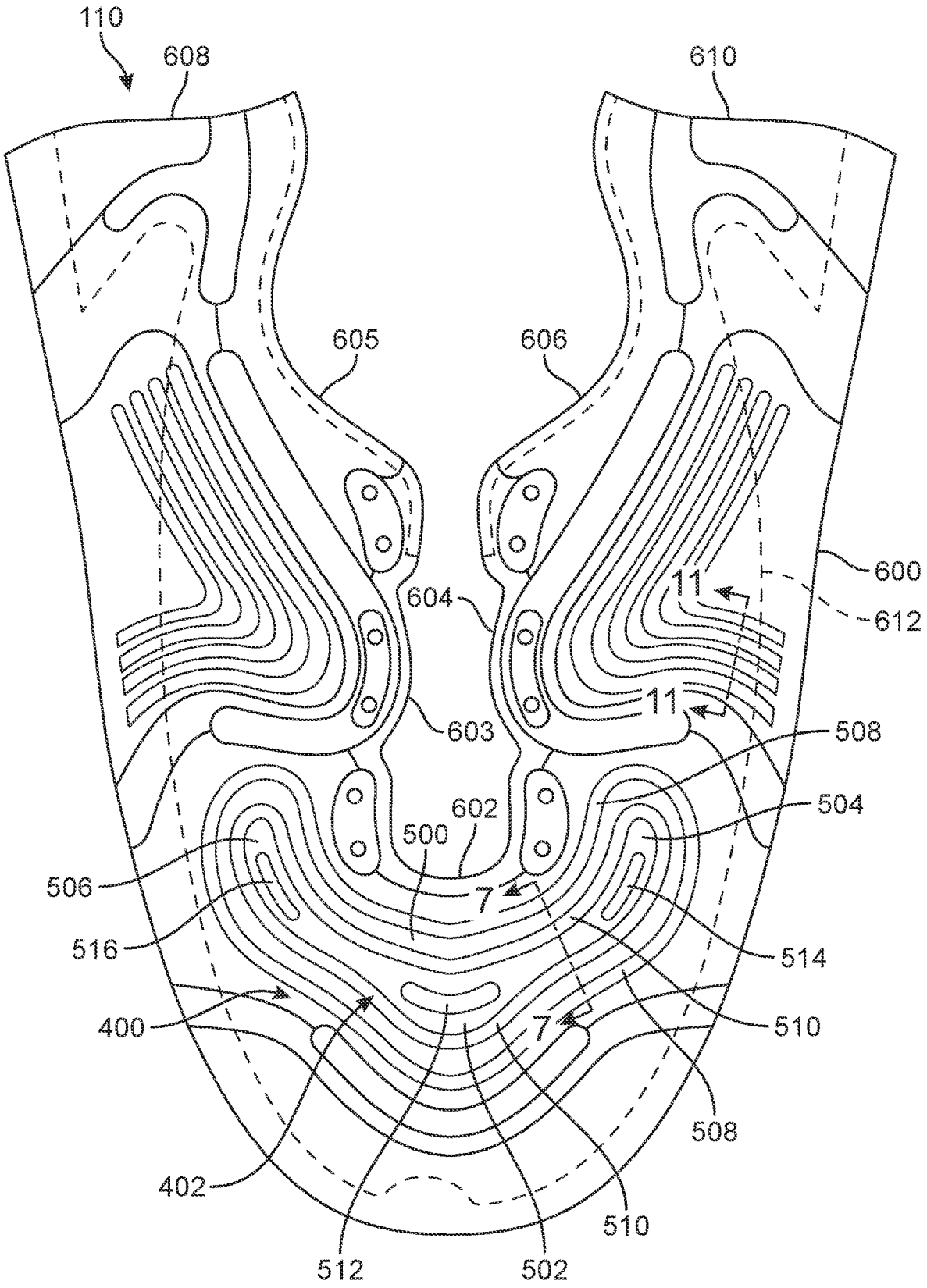
FIG. 6 is a schematic plan view of an example embodiment of an upper with airflow features for an article of footwear.

FIG. 6 illustrates a schematic plan view of an example embodiment of upper 110 with airflow features for article of footwear 100. In this embodiment, upper 110 formed at least in part by a three-dimensional engineered textile is shown laid flat prior to being assembled into an article of footwear, for example, article 100, described above. As shown in FIG. 6, upper 110 has an outer peripheral edge 600 that extends around an outer perimeter of upper 110. Upper 110 also includes an inner peripheral edge 602 that extends through the throat area of upper 110 and includes a medial inner edge 603 and a lateral inner edge 604. In some embodiments, a tongue (e.g., tongue 118) may be attached at front end 119 of inner peripheral edge 602 and extend upwards towards opening 112 adjacent to medial inner edge 603 and lateral inner edge 604.

In this embodiment, upper 110 also includes a medial collar edge 605 and a lateral collar edge 606 that define opening 112, described above, when upper 110 is assembled into article 100. Additionally, upper 110 includes a medial heel edge 608 and a lateral heel edge 610. Medial heel edge 608 and lateral heel edge 610 are configured to be connected, for example, by stitching and/or adhesives, to join together to close opening 112 at the heel end 202 of article 100. Also shown in FIG. 6 is a representation of a bite line 612 that is spaced apart from outer peripheral edge 600 along the outer perimeter of upper 110. As described above, bite line 612 may represent or define the boundary where upper 110 and sole assembly 120 meet on each side of article 100. For example, as shown in FIGS. 1-5, bite line 612 may correspond to the location of upper edge 206 of sole assembly 120 on medial side 40 and lateral side 50 of upper 110 when upper 110 and sole assembly 120 are joined to form article 100.

Figure 7:
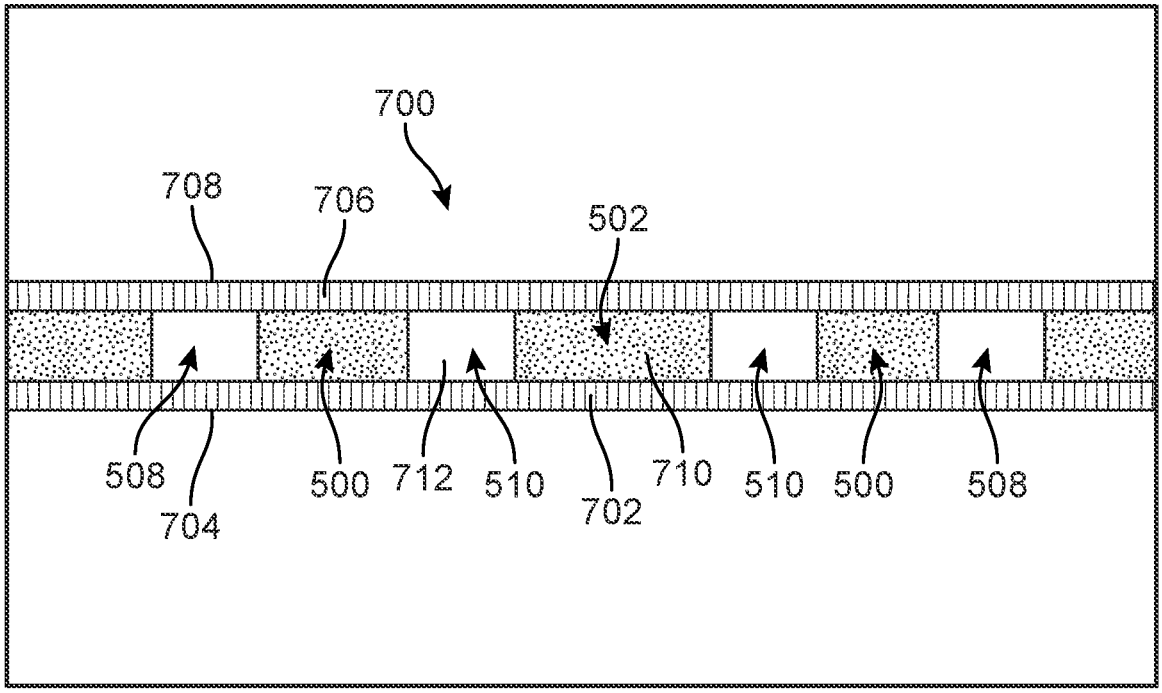
FIG. 7 is a cross-sectional view of the example embodiment of the upper with airflow features shown in FIG. 6 taken along line 7-7 in a forefoot region.

FIG. 7 is a cross-sectional view of the example embodiment of upper 110 with airflow features shown in FIG. 6 taken along line 7-7 in forefoot region 10. As described above, in some embodiments, at least forefoot region 10 of upper 110 is formed by a three-dimensional engineered textile 700. Three-dimensional engineered textile 700 includes an inner section 702 having an interior side 704 facing towards an interior of upper 110 and an outer section 706 having an exterior side 708 facing towards an exterior of upper 110 (i.e., facing in a direction opposite from interior side 704 of inner section 702).

In this embodiment, three-dimensional engineered textile 700 also includes an intermediate section 710 that is disposed between inner section 702 and outer section 706. Intermediate section 710 is attached to inner section 702 on one side (e.g., on a side opposite interior side 704) and is also attached to outer section 706 on an opposite side (e.g., on a side opposite exterior side 708). In an example embodiment, intermediate 710 is attached to inner section 702 and outer section 706 as part of the manufacturing process of forming three-dimensional engineered textile 700. That is, in contrast to conventional multi-layer arrangements for footwear uppers that attach layers onto each other using adhesives or bonding, three-dimensional engineered textile 700 is manufactured as a single textile component with multiple sections integrally connected to each other as part of the manufacturing process, for example, through weaving, knitting, or other forms of textile production.

In accordance with the principles of the example embodiments, upper 110 is provided with airflow features at least in forefoot region 10 of upper 110 to provide ventilation to a foot of a wearer of article 100. In an example embodiment, the airflow features may be provided by empty spaces 712 manufactured in three-dimensional engineered textile 700 between inner section 702 and outer section 706. That is, empty spaces 712 are areas of three-dimensional engineered textile 700 where intermediate section 710 is absent or not present. These empty spaces 712 allow air to move or flow between the interior of upper 110 and the exterior to provide ventilation to a foot of a wearer of article 100 in at least forefoot region 10.

In an example embodiment, three-dimensional engineered textile 700 may be manufactured with intermediate section 710 selectively interrupted by empty spaces 712 in a predefined arrangement to form plurality of curving portions 400 separated by gaps 402, as described above. For example, as shown in the cross-section view of FIG. 7, two sections of first curving portion 500 are shown spaced apart from the remaining portions of upper 110 by two empty spaces 712 that correspond with first gap 508. Similarly, one section of second curving portion 502 is shown spaced apart from the two sections of first curving portion 500 by two empty spaces 712 that correspond with second gap 510. As can be seen in FIG. 7, second curving portion 502 is surrounded by and bounded on either side by first curving portion 500 with second gap 510 disposed therebetween spacing apart second curving portion 502 and first curving portion 500.

In some embodiments, inner section 702 of three-dimensional engineered textile 700 extends continuously over plurality of curving portions 400 and gaps 402 formed in intermediate section 710 on one side and outer section 706 of three-dimensional engineered textile 700 extends continuously over plurality of curving portions 400 and gaps 402 formed in intermediate section 710 on the opposite side throughout at least forefoot region 10 of upper 110. With this arrangement, intermediate section 710 and empty spaces 712 which form gaps 402 are disposed between inner section 702 and outer section 706 on either side. In one embodiment, inner section 702 and/or outer section 706 may be made of a mesh material having a net-like open appearance with a plurality of openings between the yarns forming three-dimensional engineered textile 700. Together, the mesh material forming inner section 702 and/or outer section 706 and the selectively placed gaps 402 between plurality of curving portions 400 can provide improved ventilation to at least forefoot region 10 of upper 110 of article 100.

Figure 8:
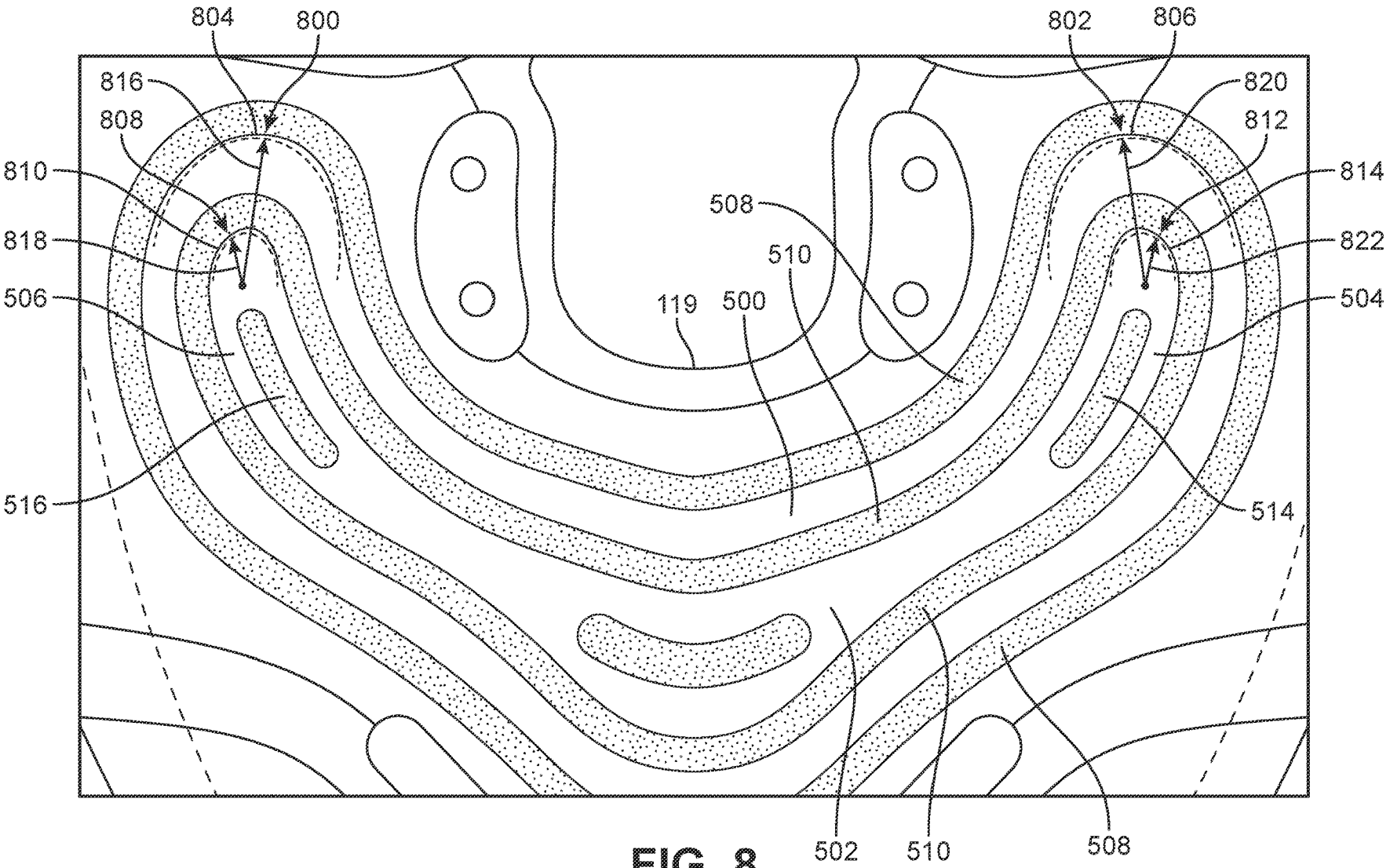
FIG. 8 is an enlarged plan view of an example embodiment of a forefoot region of the upper with airflow features showing curvature of curving portions.

FIG. 8 is an enlarged plan view of forefoot region 10 of upper 110 having airflow features in the form of plurality of curving portions 400 separated by gaps 402. As described above, in some embodiments, curving portions of plurality of curving portions 400 may have the form of a closed or broken loop that extends around a periphery of forefoot region 10 of upper 110. For example, in this embodiment, first curving portion 500 is a first loop that extends laterally across the top portion of forefoot region 10 of upper 110 and changes direction at a first location 800 adjacent to midfoot region 20 of upper 110 on medial side 40. The first loop formed by first curving portion 500 also extends laterally across the top portion of forefoot region 10 of upper 110 in the opposite direction where it changes direction at a second location 802 adjacent to midfoot region 20 of upper 110 on lateral side 50. The first loop formed by first curving portion 500 extends downward from each of first location 800 and second location 802 to connect with itself near toe end 200 of upper 110.

In an example embodiment, the first loop formed by first curving portion 500 includes a first bend 804 at first location 800 and a second bend 806 at second location 802. As shown in FIG. 8, first bend 804 of the first loop formed by first curving portion 500 defines a curve having a first radius of curvature 816. In general, a radius of curvature equals a radius of a circular arc which best approximates a curve at that specific point. A smaller radius of curvature represents a sharper curve that curves more or to a greater amount or degree than a larger radius of curvature. In this embodiment, first radius of curvature 816, therefore, is the radius of the circular arc that approximates the curve of first bend 804 at first location 800. Similarly, second bend 806 of the first loop formed by first curving portion 500 defines a curve having a second radius of curvature 820 at second location 802.

As shown in FIG. 8, second curving portion 502 of plurality of curving portions 400 is in the form of a second loop located inside the first loop formed by first curving portion 500 (i.e., nested within the first loop). The second loop formed by second curving portion 502 extends laterally across the top portion of forefoot region 10 of upper 110 and changes direction at a third location 808 adjacent to midfoot region 20 of upper 110 on medial side 40 inward from first location 800 of first curving portion 500 in a direction towards toe end 200 of upper 110. The second loop formed by second curving portion 502 also extends laterally across the top portion of forefoot region 10 of upper 110 in the opposite direction where it changes direction at a fourth location 812 adjacent to midfoot region 20 of upper 110 on lateral side 50 inward from second location 802 of first curving portion 500 in a direction towards toe end 200 of upper 110. The second loop formed by second curving portion 502 extends downward from each of third location 808 and fourth location 812 to connect with itself near toe end 200 of upper 110, inward of where first curving portion 500 connects with itself.

In an example embodiment, the second loop formed by second curving portion 502 includes a third bend 810 at third location 808 and a fourth bend 814 at fourth location 812. As shown in FIG. 8, third bend 810 of the second loop formed by second curving portion 502 defines a curve having a third radius of curvature 818 at third location 808. Fourth bend 814 of the second loop formed by second curving portion 502 defines a curve having a fourth radius of curvature 822 at fourth location 812.

In one embodiment, the curves of the second loop formed by second curving portion 502 are sharper curves (i.e., exhibit a greater amount or degree of curvature) than the curves of the first loop formed by first curving portion 500, which curve in a more gradual manner than the curves of the second loop. For example, as shown in FIG. 8, third radius of curvature 818 of third bend 810 at third location 808 is smaller than first radius of curvature 816 of first bend 804 at first location 800 such that third bend 810 forms a sharper curve than first bend 804. Similarly, on the other side of forefoot region 10, fourth radius of curvature 822 of fourth bend 814 at fourth location 812 is smaller than second radius of curvature 820 of second bend 806 at second location 802 such that fourth bend 814 forms a sharper curve than second bend 806.

Figure 9:
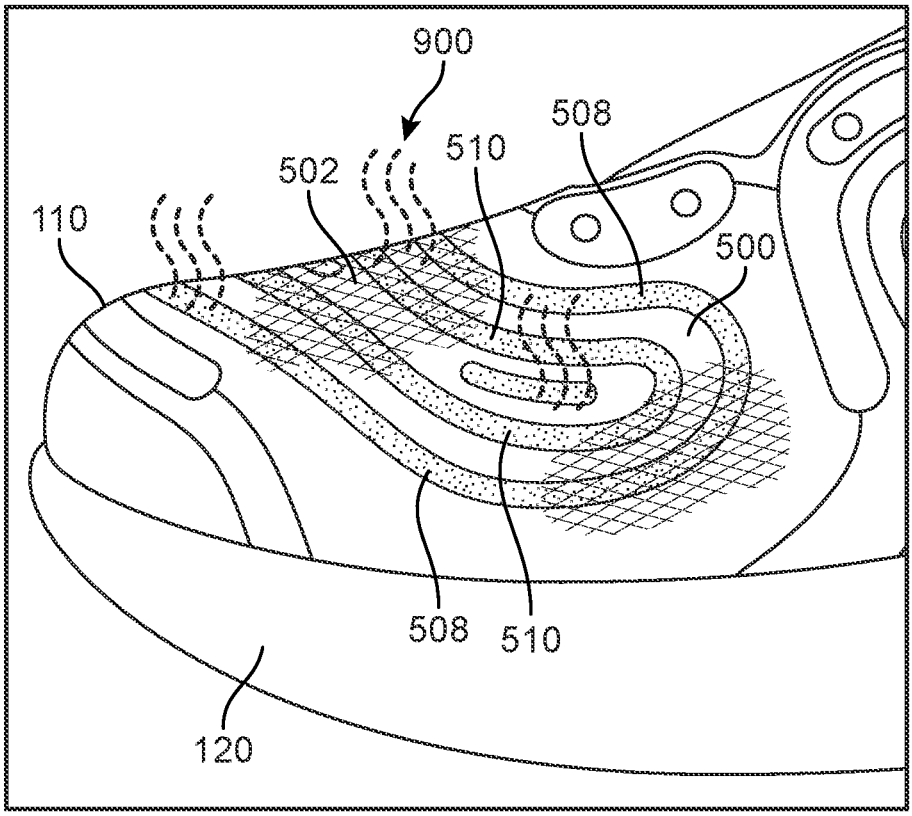
FIG. 9 is a representative view of an example embodiment of an article of footwear including an upper with airflow features providing ventilation in a forefoot region.

Referring now to FIG. 9, a representative view of article of footwear 100 including upper 110 with airflow features providing ventilation in forefoot region 10 is shown. In accordance with the techniques of the example embodiments described herein, airflow features provided by three-dimensional engineered textile 700 having plurality of curving portions 400 separated by gaps 402 allow air 900 to move or flow from within the interior of upper 110 of article 100 to the exterior through one or more gaps 402 between neighboring curving portions of plurality of curving portions 400 to provide ventilation for a foot of a wearer.

For example, as shown in FIG. 9, air 900 flows from the interior of upper 110 to the exterior through one or more of first gap 508 and second gap 510 in forefoot region 10. In this embodiment, first gap 508 surrounds first curving portion 500 and second gap 510 is disposed between first curving portion 500 and second curving portion 502 which are neighboring each other or located adjacent to one other and are spaced apart by second gap 510. With this arrangement, air 900 may flow through empty spaces 712 in intermediate section 710 of three-dimensional engineered textile 700 corresponding to gaps 402, including first gap 508 and/or second gap 510, to provide ventilation to forefoot region 10 of upper 110. Additionally, in some cases, inner section 702 and/or outer section 706 of three-dimensional engineered textile 700 may be a mesh material in at least forefoot region 10 to further assist with providing ventilation to upper 110 of article 100.

In some embodiments, other regions or portions of upper 110 may have different arrangements or configurations than forefoot region 10, described above. For example, in an example embodiment, portions of midfoot region 20 and/or heel region 30 may include a three-dimensional engineered textile that is the same or different from the arrangement or configuration of three-dimensional engineered textile 700 in forefoot region 10.

Figure 10:
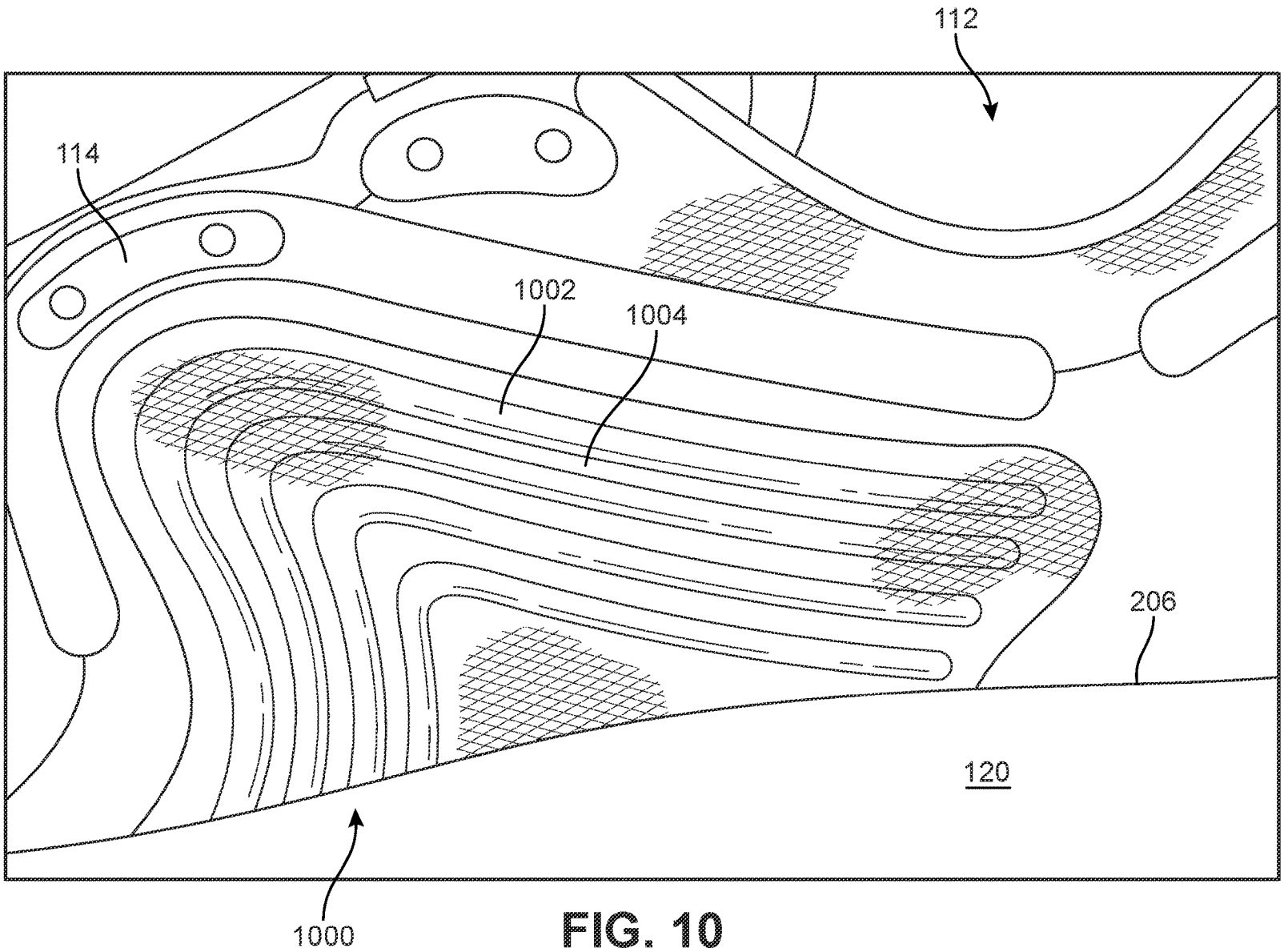
FIG. 10 is an enlarged view of a lateral side in a midfoot region of an example embodiment of an article of footwear showing molded ridges in the upper.

Referring now to FIG. 10, an enlarged view of lateral side 50 in midfoot region 20 of article of footwear 100 is shown illustrating a plurality of molded ridges 1000 arranged on upper 110. It should be understood that while only lateral side 50 is shown in FIG. 10, medial side 40 of upper 110 may have a substantially similar configuration. In this embodiment, midfoot region 20 of upper 110 is formed, at least in part, by a three-dimensional engineered textile that is molded to create plurality of molded ridges 1000 on lateral side 50. Plurality of molded ridges 1000 include one or more individual molded ridges, for example, a first molded ridge 1002, that are spaced apart or separated by depressions, such as a first depression 1004 located adjacent to first molded ridge 1002.

In an example embodiment, plurality of molded ridges 1000 have a contoured arrangement on lateral side 50 (as well as a similar arrangement on medial side 40). As shown in FIG. 10, the contoured arrangement of plurality of molded ridges 1000 includes multiple individual molded ridges that follow along a curving or other irregular path and are separated from each other by a series of depressions, such as first depression 1004, that space each molded ridge apart from adjacent molded ridges by a substantially similar distance. In this embodiment, the contoured arrangement of plurality of molded ridges 1000 extends upwards from upper edge 206 of sole assembly 120, changes direction adjacent to a lace receiving member (e.g., one of lace receiving members 114), and continues in a substantially longitudinal direction along upper 110 towards heel end 202 of article 100, terminating at a location beneath opening 112. With this arrangement, lateral side 50 and/or medial side 40 of upper 110 may provide an improved fit and feel to a foot of a wearer of article 100.

The example embodiment illustrated in FIG. 10 is one exemplary arrangement of plurality of molded ridges 1000 in midfoot region 20 of upper 110. In other embodiments, the arrangement of plurality of molded ridges 1000 may be different. Additionally, in still other embodiments, the arrangement of plurality of molded ridges 1000 on medial side 40 and lateral side 50 of upper 110 may be different on each side.

Figure 11:
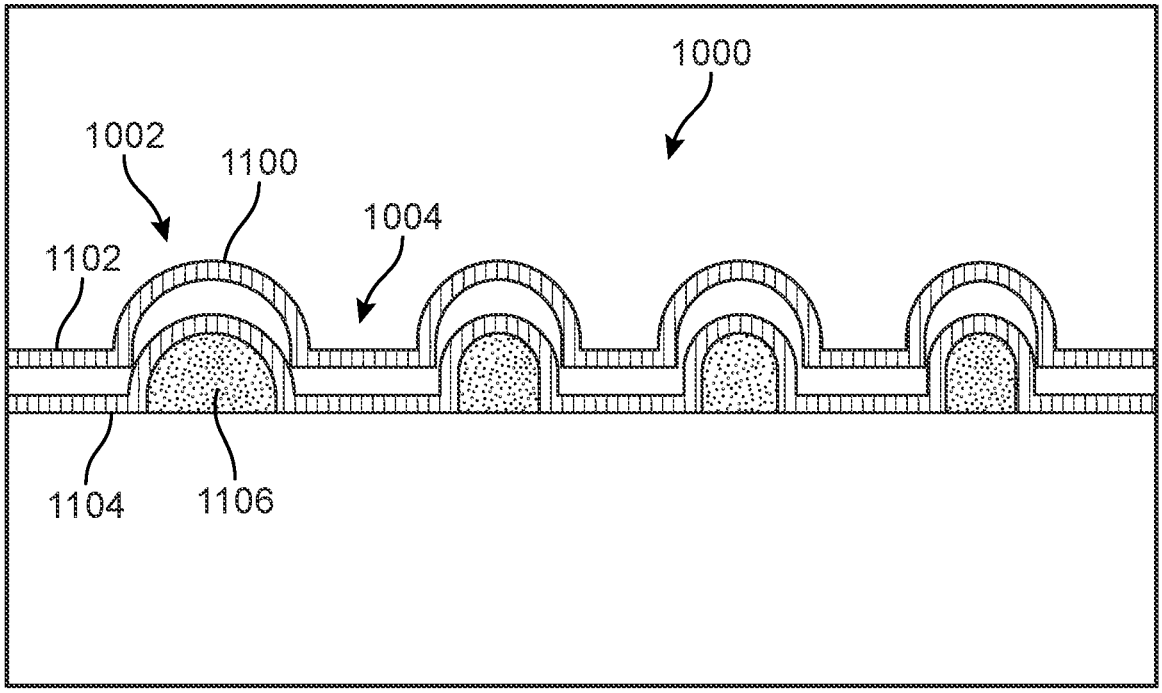
FIG. 11 is a cross-sectional view of the example embodiment of the upper with airflow features shown in FIG. 6 taken along line 11-11 in a midfoot region.

FIG. 11 is a cross-sectional view of the example embodiment of upper 110 with airflow features shown in FIG. 6 taken along line 11-11 in midfoot region 20 that includes plurality of molded ridges 1000. In an example embodiment, upper 110 may be formed at least in part by a three-dimensional engineered textile 1100 in at least midfoot region 20. As shown in FIG. 11, three-dimensional engineered textile 1100 includes a first section 1102 having an exterior side facing towards an exterior of upper 110 and an second section 1104 facing towards an interior of upper 110 (i.e., facing in a direction opposite from first section 1102). In some embodiments, one or more portions of three-dimensional engineered textile 1100 may also include an inner section 1106 that is disposed beneath each of first section 1102 and second section 1104 along a Z-axis that extends through a thickness of three-dimensional engineered textile 1100.

In one embodiment, the locations of inner section 1106 correspond to one or more molded ridges of plurality of ridges 1000. For example, as shown in FIG. 11, inner section 1106 is located beneath first section 1102 and second section 1104 at a location corresponding to first molded ridge 1002. Inner section 1106 pushes first section 1102 and second section 1104 of three-dimensional engineered textile 1100 upwards (e.g., in a direction away from the interior of upper 110) to form first molded ridge 1002. In contrast, first depression 1004 located adjacent to first molded ridge 1002 does not include inner section 1106. That is, at the location of first depression 1004, inner section 1106 is absent or not present in three-dimensional engineered textile 1100. By selectively providing inner section 1106 at one or more locations corresponding to the molded ridges of plurality of molded ridges 1000 and omitting inner section 1106 in between (i.e., at locations of depressions, such as first depression 1004), the contoured arrangement of plurality of molded ridges 1000 may be provided in midfoot region 20 of upper 110.

In one embodiment, inner section 1106 of three-dimensional engineered textile 1100 may be a foam layer made of a compressible foam material. In some cases, three-dimensional engineered textile 1100 with inner section 1106 in the form of a foam layer may be molded using heat and/or pressure, for example, using a heated press apparatus, to form plurality of molded ridges 1000 with the contoured arrangement described herein.

In some cases, three-dimensional engineered textile 1100 may be manufactured together with three-dimensional engineered textile 700, described above. In these cases, three-dimensional engineered textile 1100 and three-dimensional engineered textile 700 may be formed together with different arrangements in forefoot region 10 and midfoot region 20, as described in the example embodiments. In other embodiments, three-dimensional engineered textile 1100 and three-dimensional engineered textile 700 may be manufactured as separate components and may be joined together using stitching or bonding techniques to form upper 110.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

The invention claimed is:

1. An upper for an article of footwear, comprising:

a three-dimensional engineered textile, including an inner section, an outer section, and an intermediate section disposed between the inner section and the outer section along a Z-axis that extends through a thickness of the three-dimensional engineered textile, wherein the three-dimensional engineered textile is a single textile component with the inner section, the outer section, and the intermediate section integrally connected to each other by knitting or weaving;

wherein the intermediate section is attached to the inner section on one side and the outer section on an opposite side;

the intermediate section extending through at least a forefoot region of the upper;

wherein, in the forefoot region, the intermediate section comprises a plurality of curving portions arranged adjacent to each other such that each curving portion of the plurality of curving portions is spaced apart from neighboring curving portions by one or more gaps; and wherein the upper is configured to allow air to flow between an interior of the upper and an exterior of the upper through the one or more gaps between neighboring curving portions of the plurality of curving portions in the forefoot region of the upper.

2. The upper according to claim 1, wherein the plurality of curving portions form a plurality of loops arranged in a nested configuration such that each loop of the plurality of loops is spaced apart from each adjacent loop by a gap of the one or more gaps.

3. The upper according to claim 2, further comprising a triangular shaped looped portion disposed approximately in a middle of the forefoot region on a top portion of the upper.

4. The upper according to claim 3, further comprising a medial loop on a medial side of the forefoot region and a lateral loop lateral side of the forefoot region.

5. The upper according to claim 4, wherein each of the medial loop and the lateral loop includes a central opening.

6. The upper according to claim 4, wherein the medial loop extends from a first end of the triangular shaped looped portion on one side and the lateral loop extends from a second end of the triangular shaped looped portion on an opposite side.

7. An upper for an article of footwear, comprising:

a three-dimensional engineered textile, including an inner section, an outer section, and an intermediate section disposed between the inner section and the outer section along a Z-axis that extends through a thickness of the three-dimensional engineered textile, wherein the three-dimensional engineered textile is a single textile component with the inner section, the outer section, and the intermediate section integrally connected to each other by knitting or weaving;

wherein the intermediate section is attached to the inner section on one side and the outer section on an opposite side;

the intermediate section extending through at least a forefoot region of the upper;

wherein, in the forefoot region, the intermediate section comprises at least a first curving portion and a second curving portion arranged adjacent to each other so that the first curving portion is spaced apart from the second curving portion by a gap; and wherein the upper is configured to allow air to flow from an interior of the upper to an exterior of the upper through the gap between the first curving portion and the second curving portion in the forefoot region of the upper.

8. The upper according to claim 7, wherein the first curving portion comprises a first loop and the second curving portion comprises a second loop, the first loop and the second loop arranged in a nested configuration such that the first loop is spaced apart from the second loop by the gap.

9. The upper according to claim 8, wherein the second loop is smaller than the first loop and wherein the second loop is bounded inside the first loop.

10. The upper according to claim 8, wherein the first loop extends from an outer periphery of a medial side of the forefoot region through an outer periphery in a toe portion adjacent to a toe end of the upper to an outer periphery of a lateral side of the forefoot region across a top portion of the forefoot region adjacent to a front end of a throat area and connects back with itself at the outer periphery of the medial side of the forefoot region.

11. The upper according to claim 8, wherein the first loop changes direction at a first location adjacent to a midfoot region of the upper on a medial side; and wherein the first loop changes direction at a second location adjacent to the midfoot region of the upper on a lateral side.

12. The upper according to claim 11, wherein the first loop forms a first bend at the first location and a second bend at the second location.

13. The upper according to claim 12, wherein the second loop changes direction at a third location adjacent to the midfoot region of the upper on the medial side; and wherein the third location is inward from the first location in a direction towards a toe end of the upper.

14. The upper according to claim 13, wherein the second loop changes direction at a fourth location adjacent to the midfoot region of the upper on the lateral side, wherein the fourth location is inward from the second location in a direction towards the toe end of the upper.

15. The upper according to claim 14, wherein the second loop forms a third bend at the third location and a fourth bend at the fourth location.

16. The upper according to claim 15, the first bend having a first radius of curvature, the third bend having a third radius of curvature, wherein the third radius of curvature is smaller than the first radius of curvature such that the third bend forms a sharper curve than the first bend.

17. The upper according to claim 15, the second bend having a second radius of curvature, the fourth bend having a fourth radius of curvature, wherein the fourth radius of curvature is smaller than the second radius of curvature such that the fourth bend forms a sharper curve than the second bend.

18. An upper for an article of footwear, comprising:

a three-dimensional engineered textile, the three-dimensional engineered textile including an inner section, an outer section, and an intermediate section disposed between the inner section and the outer section along a Z-axis that extends through a thickness of the three-dimensional engineered textile, wherein the three-dimensional engineered textile is a single textile component with the inner section, the outer section, and the intermediate section integrally connected to each other by knitting or weaving;

wherein the intermediate section is attached to the inner section on one side and the outer section on an opposite side;

the intermediate section extending through at least a forefoot region of the upper;

wherein, in the forefoot region, the intermediate section comprises a plurality of curving portions arranged adjacent to each other such that each curving portion of the plurality of curving portions is spaced apart from neighboring curving portions by one or more gaps; and wherein, in a midfoot region of the upper, the inner section comprises a foam.

19. The upper according to claim 18, further comprising a plurality of molded ridges formed in the three-dimensional engineered textile having a contoured arrangement on each of a medial side and a lateral side.

20. The upper according to claim 19, wherein each molded ridge of the plurality of molded ridges is separated from each adjacent molded ridge by a depression where the foam is absent.

* * * * *